US006182423B1

(12) United States Patent
Gallmann

(10) Patent No.: US 6,182,423 B1
(45) Date of Patent: Feb. 6, 2001

(54) WIRE TIE DISPENSING/PACKAGING SYSTEM

(76) Inventor: Richard F. Gallmann, 801 Old Spanish Trail, Slidell, LA (US) 70458

( * ) Notice: Under 35 U.S.C. 154(b), the term of this patent shall be extended for 0 days.

(21) Appl. No.: 09/356,577

(22) Filed: Jul. 19, 1999

(51) Int. Cl.[7] ..... B65B 21/06

(52) U.S. Cl. ..... 53/443; 53/459; 53/469; 53/501; 53/248; 53/255; 53/284.7; 53/570

(58) Field of Search ..... 53/495, 501, 443, 53/444, 459, 473, 469, 531, 147, 570, 571, 572, 247, 248, 255, 284.7, 236, 148, 409, 581; 140/73

(56) References Cited

U.S. PATENT DOCUMENTS 1,162,675 11/1915 Bates .
1,333,994 3/1920 Page .
3,956,866 * 5/1976 Lattur ..... 53/459
4,338,714 * 7/1982 Powderly ..... 53/397
5,709,069 * 1/1998 Cronauer ..... 53/459

* cited by examiner

*Primary Examiner*—Linda Johnson
(74) *Attorney, Agent, or Firm*—Joseph T. Regard, Ltd.

(57) ABSTRACT

A system for dispensing and packaging wire ties directly from a wire tie forming machine. While the prior art contemplates dispensing wire ties along first and second flexible strings or wires to form a coil of ties having the first and second strings or wires passing through first and second eyelets, respectively, formed in the ties, the present invention teaches first and second, rigid rods emanating from the first and second tying anvils on the tie forming machine, which rods are configured to slide each formed tie away from the tie forming machine, wherein the ties are counted via electric eye or the like and selectively dispensed into a package via computer controlled actuator. Bagging a quantity of the ties in this fashion provides an automated, dependable, economical system for packaging the specified quantity of ties, and is particularly useful for smaller lots of ties, for example, 500 ties or less.

19 Claims, 4 Drawing Sheets

WIRE TIE DISPENSING/PACKAGING SYSTEM

TECHNICAL FIELD of the INVENTION

The present invention relates to packaging systems, and in particular to a system for dispensing and packaging wire ties directly from a wire tie forming machine. While the prior art contemplates dispensing wire ties along first and second flexible strings or wires to form a coil of ties having the first and second strings or wires passing through first and second eyelets, respectively, formed in the ties, the present invention teaches first and second, rigid rods emanating from the first and second tying anvils on the tie forming machine, which rods are configured to slide each formed tie away from the tie forming machine, wherein the ties are counted via electric eye or the like and selectively dispensed into a package via computer controlled actuator. Bagging a quantity of the ties in this fashion provides an automated, dependable, economical system for packaging the specified quantity of ties, and is particularly useful for smaller lots of ties, for example, 500 ties or less.

BACKGROUND OF THE INVENTION

Wire tie forming machines have been utilized in various forms to facilitate various configurations of wire ties such as, for example, bale wire ties, re-bar (reinforcement bar) ties as utilized in reinforcing poured concrete, packaging ties and the like. However, it is believed that there has not been provided to facilitate a cost effective and reliable system for packaging smaller selected quantities of ties.

The known prior art has contemplated, for example, as shown in U.S. Pat. No. 1,162,675 to Bates, a "Wire Tie Forming Machine" dated Nov. 30, 1915 wherein the ties have formed at first and second ends eyelets about first and second strings, which strings support the ties and allow same to gather together, such that the gathered ties and strings are rolled into a coil.

The coil is then ready for sale to a customer, who removes the ties from the coil as needed. This method of packaging is still utilized to today, and is fine for large quantities of thousands of ties, as may be used in construction of roads, bridges, concrete structures, or the like, but is not cost effective or an efficient means of packaging smaller quantities of ties, for example, 500 ties or less at a time, as may be purchased by a handyman or gardener for use around the house or garden.

GENERAL SUMMARY DISCUSSION OF THE INVENTION

The present invention provides a system for the packaging and distribution of wire ties which is more cost effective, more efficient to store and utilize, and easier b maintain and implement when compared to prior art systems, particularly with regard to packaging relatively small amounts of wire ties or the like for retail sale.

The present invention requires the modification of existing machinery, the combination of machinery which has heretofore not been offered in combination, and the implementation of off the shelf technologies including sensors, actuators, computers, and the like in a manner which is believed to be unobvious, novel, and functional in light of the prior art.

An exemplary embodiment of the present invention utilizes a wire tire machine having a general working design similar to that contemplated in Bates 1,162,675 patent but modified such that, instead of first and second strings being dispensed from the first and second tie anvils for the wire tie process, first and second, rigid rods have been provided, which rods are spaced in parallel in downwardly sloping fashion from the anvils, such that the tied first and second loops or eyelets formed at approaching ends of each tie pass about each of the first and second rods, respectively, so as to allow each tie to slide down the first and second rods via the first and second eyelets formed therein, away from the tying apparatus.

As each tie slides along about midway down the rods, the ties pass between a light sensor and light source, or other sensor, which records the ties presence. The ties then are blocked from further passage along the rods via a stop member inserted between the rods, which stop member is controlled by a solenoid or actuator controlled via a CPU, which monitors the sensor for the appropriate number of ties passing thereunder.

When the appropriate number of ties have traversed under the sensor, the actuator is energized to lift the stop member for a period of time to allow the gathered ties to slide down the ends of the rods into a dispensed bag positioned thereunder, after which the actuator resets the stop member between the rods, the CPU resets the counter, the filled bag is automatically sealed by the bag machine, the bag is released and a new open bag placed into position by the bag machine, at which time the process repeats, and so on.

It is therefore an object of the present invention to provide a tie packaging system which may be utilized with a variety of wire tieing machines.

It is another object of the present invention to provide a wire tie packaging system which facilitates more efficient packaging of wire ties to the conventional systems, which systems have been in use for over 50 years.

It is another object of the present invention to provide a wire tie packaging system which is cost effective to operate, easy to implement, and low in maintenance.

It is another object of the present invention to provide a wire tie packaging system which may be utilized to package other products, and not particularly limited to wire ties.

Lastly, it is an object of the present invention to provide a method and system for providing an accurate count of wire ties in a bag for retail sale in a cost effective, fast manner, and with nominal manual labor intervention.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
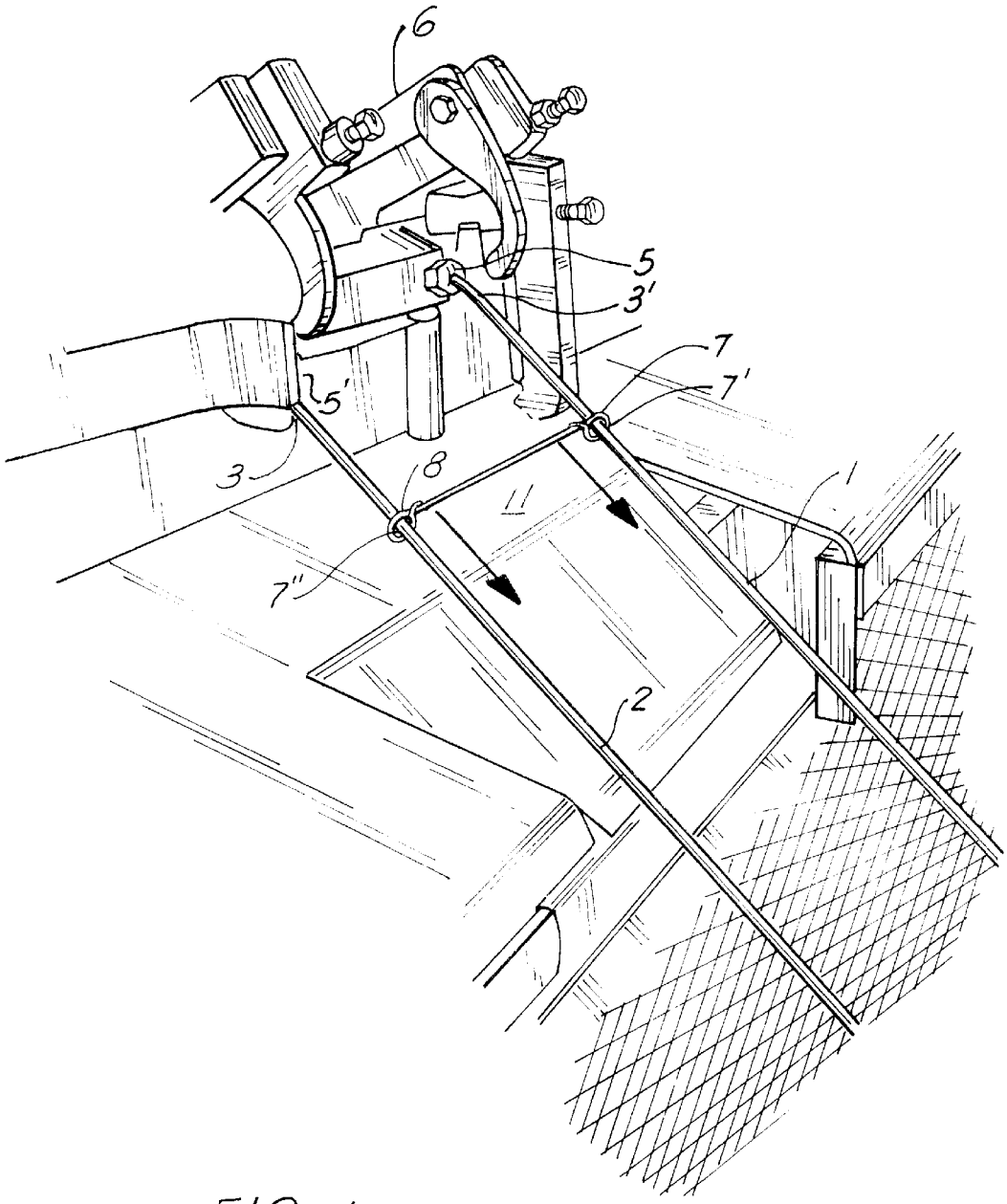
FIG. 1 is an isometric view of the wire tying mechanism of the present invention converted to have emanating therefrom first and second rigid rods downwardly sloping from first and second tie anvils on the machine, respectively, so as to facilitate the support and sliding movement of a tie from the machine, as shown.
Figure 2:
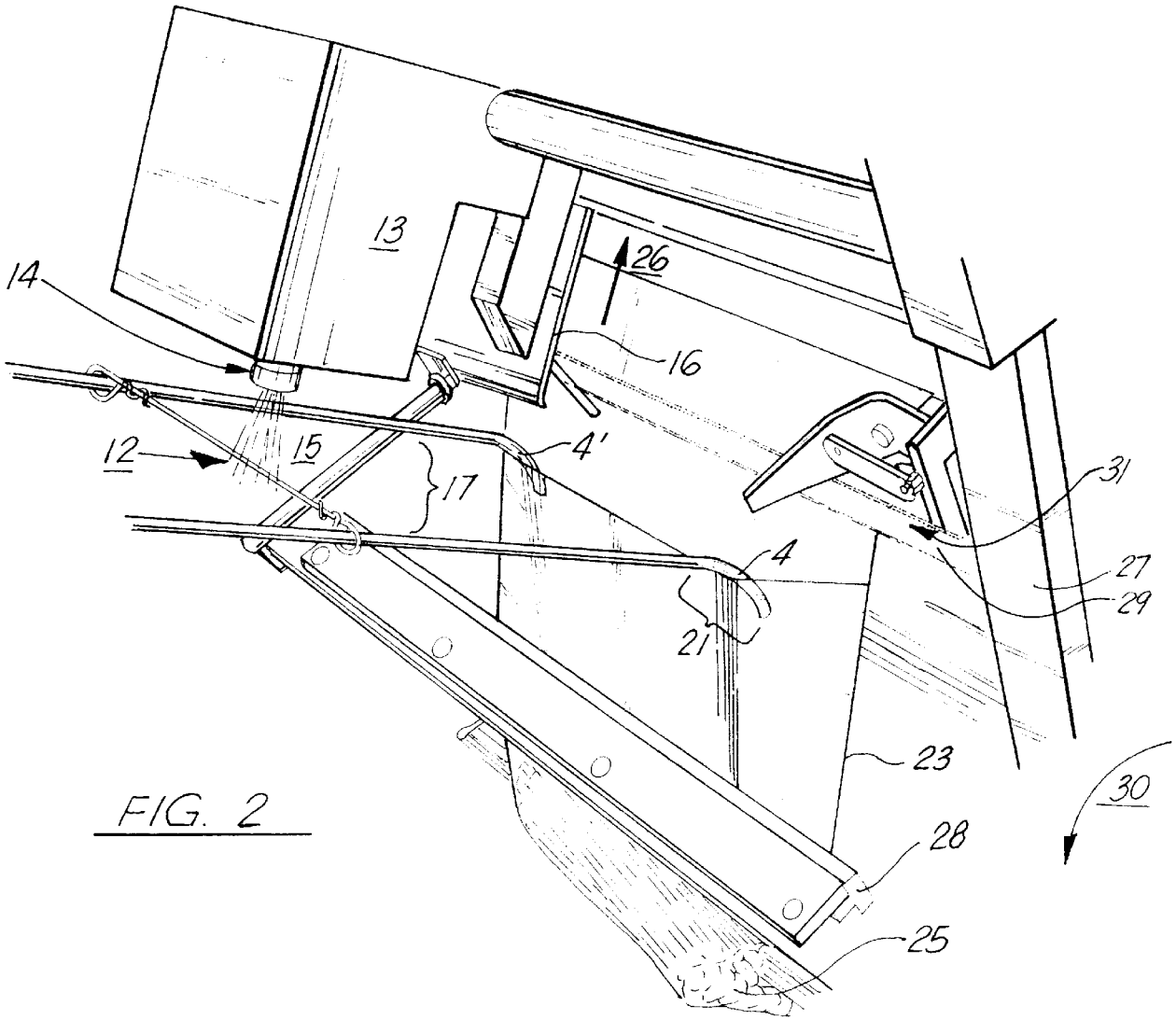
FIG. 2 is an isometric view of the distal ends of the first and second rods of FIG. 1, wherein there the ends of the rods are positioned to guide ties thereupon into an open bag mouth, and wherein there is further shown a light sensor, CPU, and actuator for controlled dispensing of the ties into individual bags at a predetermined count.
Figures 3A, 3B:
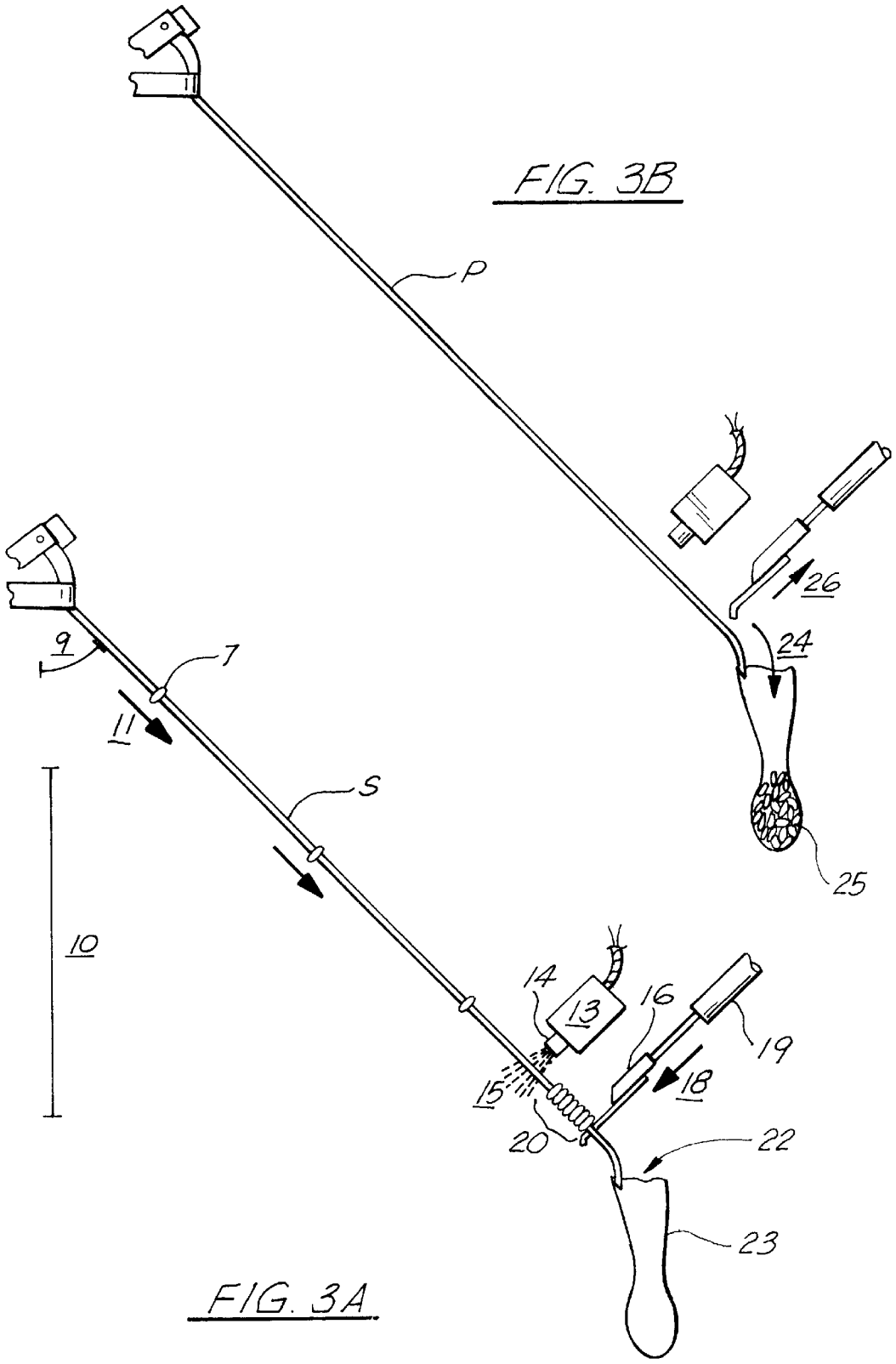
FIG. 3A is a side view of the process of the invention of FIG. 1, illustrating the formed ties sliding down the first and second rods, counted via light sensor, and accumulated via blocking member.
FIG. 3B is a side view of the process of FIG. 3A, wherein, after the predetermined ties have passed through light sensor, an actuator withdraws blocking member, and the accumulated ties continue to slide down rod into open bag.
Figure 4:
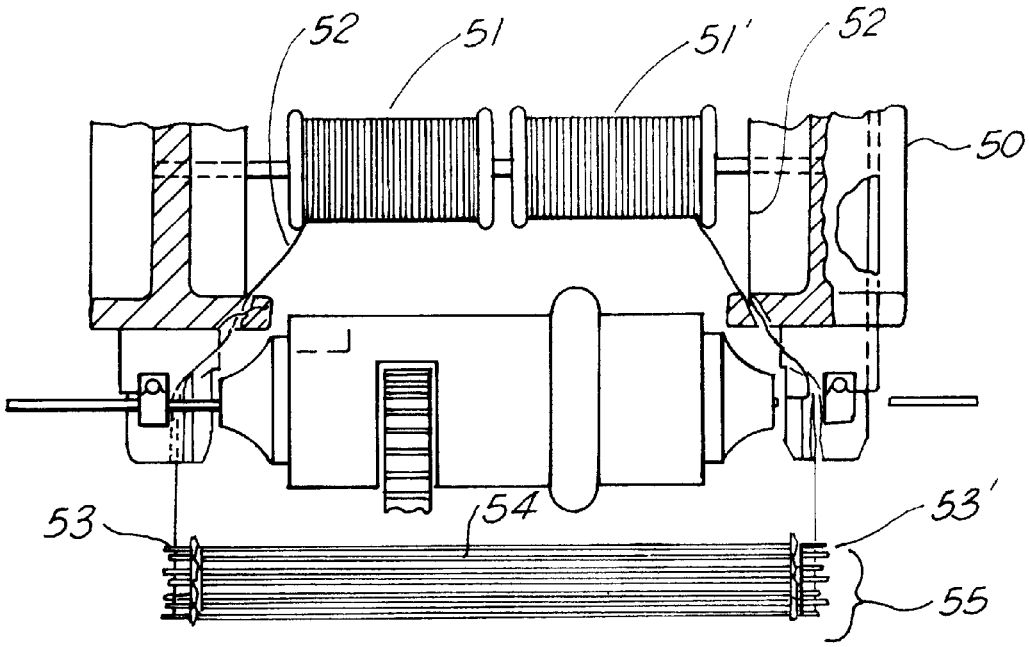
PRIOR ART FIG. 4
FIG. 4 is a front view of a prior art tie forming machine.

Wire tying machines for forming ties, even today, are often based upon designs perfected over 80 years ago, as illustrated in FIG. 4, a prior art design published in 1915. In the illustrated design 50, first 51 and second 51' spools of string dispense first 52 and second 52' string lines, respectively, about which are formed first 53 and second 53' loops at respective ends of a tie 54. The formed tie is thereby suspended by the first and second lines, held taught, with the lines and gathered 55 ties rolled into spools for later use.

Referring to FIGS. 1, 2, 3A, and 3B, the system S of the present invention converts a wire tying machine 6 for forming wire ties 7 from the prior art design above, which packaged the ties in string spools, to provide for automated bagging and packaging of small, predesignated quantities of said ties in thermoplastic bags or the like.

Continuing with the Figures, first 1 and second 2 rigid rods, each having a first 3, 3' upper end and a second 4, 4' lower end emanate from first 5 and second 5' wire forming anvils, respectively, the rods downwardly directed at an approximately, for example, 45 degree angle 9, the rods further arranged in parallel fashion relative to one another, along the same plane P, approximately, for example, 45 degrees downwardly sloping from the vertical 10.

The wire tie forming machine receives a length of wire from a spool, cuts the wire into a predetermined length having first and second end, and bends said first and second ends about first 5, and second 5' tie forming anvils to form a wire tie 7 having first 7' and second 7" ends, each having a loop 8 formed therein, respectively, the looped ends 7', 7" encircling rods 1, 2, respectively.

The formed tie 7 is configured to slide 11 along the rods 12 so as to pass 12 a counter 13, for example, a light sensor 14 which senses 15 the passage of the tie, counting same via CPU or the like, whereupon thereafter the tie is blocked from further movement along the rods via blocking member 16 situated between 17 the rods, which blocking member 16 may be lowered 18 into the blocking position via, for example, a solenoid 19 or the like.

Meanwhile, the wire tying machine continues to form wire ties, which pass in the vicinity of counter 13 and are counted, until a predetermined number of ties are gathered 20 by the blocking member, at which time the actuator 19 is energized by the CPU to raise 26 the blocking member 16, releasing the gathered ties 20 and allowing same to slide off 24 the second end 4, 4' of rods and into the mouth 22 of bag 23, providing packaged ties 25, which packaged ties are then sealed 28 via bag dispensing/sealing device 27, the sealed bag dispensed from its position, and a new bag 31 dispensed 30 into position via roller 29, which new bag is in an open position such that the opened bag mouth is situated under the curved 21, second ends of rods 1, 2, respectively, the blocking member is then lowered via the solenoid, the counter resets, so that the procedure begins again, until the desired quantity of packaged goods is achieved. Alternatively, instead of a sensor, a timer may be implemented to time the amount of time the blocking member is blocking the rods, the time corresponding to amount of time it takes the tying machine to tie a predetermined number of ties and for said ties to slide down said rods to said blocking member, or, alternatively a light sensor may be utilized to sense not the presence of individual ties for counting, but when a predetermined number of ties has been blocked by said blocking member, thereby blocking light to said light sensor.

An example of a bag dispensing/sealing device which may be utilized in the present invention is the TITAN 6500 Automatic Roll Bag System by Allied Automation of Carrolton, Tex.

As an alternative to the counter counting each tie as it passes thereby in the present system, there may be employed alternative means for discerning the appropriate amount of gathered ties for dispensing such as, for example, a dwell time, or a light sensor which is positioned such that a predetermined amount of gathered ties along the rod, blocked by the blocking member, blocks reception of light from a light source by a light sensor, which would, upon detecting the lack of the light source, energize the actuator to lift the blocking member, and resetting upon dispensing of the gathered ties into the bag.

In summary, a method of method of dispensing a tie from a wire tie forming machine having first and second wire tie forming anvils, might comprise the steps of:

a. providing a length of line having first and second ends;

b. forming first and second loops at said first and second ends of said tie, respectively, by bending said first and second ends of said tie about said the first and second wire tie forming anvils, respectively;

c. sliding the first and second loops of said wire tie about first and second inclined rods, respectively;

d. allowing said wire tie to slide along said first and second rods through said first and second loops, respectively;

e. sensing said wire tie as it slides along said first and second rods;

f. blocking said wire tie from sliding along said first and second rods;

g. utilizing said sensor, determining when a predetermined number of wire ties have been sensed; and h. unblocking said wire ties, so as to allow said wire tie to slide off of a free end of said first and second rods, respectively, providing dispensed wire ties;

i. packaging the ties;

j. repeating steps b–i.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

ELEMENTS of the Invention

Date: Friday, June 25, 1999 01:35 pm

Client: Richard F. Gallmann

Title: Wire Tie Dispensing/Packaging System

Element Description

S System

1 first rod

2 second rod

3,' first ends

4,,' second ends

5,5' anvil

6 wire tying machine
7' tie
7'," first, second ends
8 loop
9 downwardly sloping angle
10 vertical
11 slides
12 passes
13 counter
14 light sensor
15 senses
16 blocking member
17 between the rods
18 lowered
19 solenoid
20 gathered ties
21 second end of rod downwardly curved
22 mouth of
23 bag
24 gathered ties fall into
25 gathered ties in bag
26 retracted blocking member
27 bag dispensing/sealing device
28 seals bag via thermal sealing bar
29 roller
30 dispenses
31 new bag
32
33
34
35
36
37
38
39
40
41

What is claimed is:

1. A tie packaging apparatus for packaging a tie having first and second ends, said first and second ends each having first and second loops, respectively, said tie formed by a wire tie forming machine having first and second wire tie forming anvils, comprising:

first and second rods, each having a length, first and second ends, said first end of said first and second rods emanating from said first and second wire tie forming anvils so as to allow the passage of said first and second loops thereabout, respectively, said length of said first and second rods situated at an inclined angle wherein said first end of said rods are situated above said second ends of said rods, said lengths of said first and second rods situated in parallel fashion forming a medial space therebetween;

sensing means situated along said length of said first and second rods for sensing the presence of a loop traversing said first and second rods;

blocking means for selectively blocking the movement of a loop traversing said first and second rods;

control means for controlling said blocking means utilizing said sensing means, to facilitate controlled movement of a tie along said first and second rods.

2. The apparatus of claim 1, wherein said blocking means comprises a solenoid having a blocking member mounted thereupon.

3. The apparatus of claim 2, wherein said control means comprises a counter utilizing said sensor to count said ties to a predetermined amount, and a switch to energize said actuator upon said counter reaching the predetermined amount of ties.

4. The apparatus of claim 3, wherein there is further included a bag having a bag mouth situated in the vicinity of said second end of said rods, so that said bag mouth receives any ties sliding off of said second end of said first and second rods.

5. The apparatus of claim 4, wherein there is further provided a bag dispensing and sealing machine for dispensing a bag having a bag mouth such that said bag mouth is situated in the vicinity of said second ends of said rods, said sealing machine for sealing said bag after said bag has been filled with a predetermined number of ties.

6. The method of dispensing a tie from a wire tie forming machine having first and second wire tie forming anvils, comprising the steps of:

a. providing a length of line having first and second ends;

b. forming first and second loops at said first and second ends of said tie, respectively, by bending said first and second ends of said tie about said the first and second wire tie forming anvils, respectively;

c. sliding the first and second loops of said wire tie about first and second inclined rods, respectively;

d. allowing said wire tie to slide along said first and second rods through said first and second loops, respectively;

e. sensing said wire tie as it slides along said first and second rods;

f. blocking said wire tie from sliding along said first and second rods;

g. utilizing said sensor, determining when a predetermined number of wire ties have been sensed; and h. unblocking said wire tie, so as to allow said wire tie to slide off of a free end of said first and second rods, respectively, providing a dispensed wire tie.

7. The method of claim 6, wherein there is further provided the additional step "i." of bagging said dispensed wire tie.

8. The method of claim 6, wherein there is further provided the additional step "i." of packaging said dispensed wire tie.

9. The method of claim 7, wherein there is further provided the additional step "j" of sealing said bag.

10. The method of claim 6, wherein said sensor of step "e" is a light sensor, and wherein there is further provided the step of providing a counter to count said wire ties via said sensor, as to determine the number of wire ties.

11. The method of claim 6, wherein said sensor of step "e" is a light sensor, and wherein there is further provided the step of utilizing said sensor to discern when a plurality of ties has gathered due to said blocking of step "f".

12. A tie packaging apparatus for packaging a tie having first and second ends, said first and second ends each having first and second loops, respectively, said tie formed by a wire tie forming machine having first and second wire tie forming anvils, comprising:

first and second rods, each having a length, first and second ends, said first end of said first and second rods emanating from said first and second wire tie forming anvils so as to allow the passage of said first and second loops thereabout respectively, said length of said first and second rods situated at an inclined angle wherein said first end of said rods are situated above said second ends of said rods, said lengths of said first and second rods situated in parallel fashion forming a medial space therebetween;

timing means for discerning a period of time beginning from the forming of a first wire tie;

blocking means for selectively blocking the movement of a loop traversing said first and second rods;

control means for controlling said blocking means utilizing said timing means, to facilitate said blocking means of said first and second rods for a specified time, then to facilitate unblocking of said first and second rods for a specified time.

13. The apparatus of claim 12, wherein said blocking means comprises a solenoid having a blocking member mounted thereupon.

14. The apparatus of claim 13, wherein there is further included a bag having a bag mouth situated in the vicinity of said second end of said rods, so that said bag mouth receives any ties sliding off of said second end of said first and second rods.

15. The apparatus of claim 14, wherein there is further provided a bag dispensing and sealing machine for dispensing a bag having a bag mouth such that said bag mouth is situated in the vicinity of said second ends of said rods, said sealing machine for sealing said bag after said bag has been filled with a predetermined number of ties.

16. The method of dispensing a tie from a wire be forming machine having first and second wire tie forming anvils, comprising the steps of:

a. providing a length of line having first and second ends;

b. forming first and second loops at said first and second ends of said tie, respectively, by bending said first and second ends of said tie about said the first and second wire tie forming anvils, respectively;

c. sliding the first and second loops of said wire tie about first and second inclined rods, respectively;

d. allowing said wire tie to slide along said first and second rods through said first and second loops, respectively;

e. blocking said wire tie from sliding along said first and second rods;

g. determining when a predetermined amount of time has been reached; and h. unblocking said wire tie, so as to allow said wire tie to slide off of a free end of said first and second rods, respectively, providing a dispensed wire tie.

17. The method of claim 16, wherein there is further provided the additional step "i." of bagging said dispensed wire tie.

18. The method of claim 16, wherein there is further provided the additional step "i." of packaging said dispensed wire tie.

19. The method of claim 17, wherein there is further provided the additional step "j" of sealing said bag.

* * * * *